US006804917B2

(12) United States Patent
Ensign

(10) Patent No.: US 6,804,917 B2
(45) Date of Patent: Oct. 19, 2004

(54) STORAGE STRUCTURE FOR SAILPLANES AND SMALL AIRCRAFT

(76) Inventor: Richard Ensign, 1295 S. Cawston, Spade No. 494, Hemet, CA (US) 92545

( * ) Notice: Subject to any disclaimer, the term of this patent is extended or adjusted under 35 U.S.C. 154(b) by 23 days.

(21) Appl. No.: 10/300,086

(22) Filed: Nov. 20, 2002

(65) Prior Publication Data

US 2004/0093807 A1 May 20, 2004

(51) Int. Cl.[7] ..... E04B 1/344

(52) U.S. Cl. ..... 52/69; 52/23; 52/653.2; 52/DIG. 14; 244/114 R

(58) Field of Search ..... 52/69, DIG. 14, 52/23, 653.1, 653.2; 244/114 R

(56) References Cited

U.S. PATENT DOCUMENTS 2,260,369 A * 10/1941 Ebenhack ..... 52/69
2,532,456 A * 12/1950 Merritt ..... 49/40
2,610,366 A * 9/1952 McKee et al. ..... 49/40
2,759,226 A * 8/1956 McKee et al. ..... 49/140
3,034,607 A * 5/1962 Haines, Jr. ..... 52/64
3,074,518 A * 1/1963 Conrad et al. ..... 52/69
3,353,862 A * 11/1967 Tormolen ..... 410/2
3,550,333 A * 12/1970 Kliewer ..... 52/73
3,673,749 A * 7/1972 Allen ..... 52/73
3,708,200 A * 1/1973 Richards ..... 296/173
3,818,652 A * 6/1974 Pierce ..... 52/23
3,823,519 A * 7/1974 Cordova ..... 52/65
3,838,879 A * 10/1974 Lilly ..... 52/143
3,858,371 A * 1/1975 Averill ..... 52/66
3,906,691 A * 9/1975 Grenet ..... 52/236.1
3,954,197 A * 5/1976 Dean ..... 414/800
4,004,382 A * 1/1977 Carlson ..... 52/64
4,464,868 A * 8/1984 Howroyd ..... 52/69

* cited by examiner

*Primary Examiner*—Brian E. Glessner

(57) ABSTRACT

A storage structure or hangar designed primarily for housing a sailplane or other small aircraft has a substantially T-shaped pre-fabricated upper frame support anchored to the ground at several locations, a first set of frame members mounted immovably to the upper frame support in areas where the fuselage and tail and the two wings are located when the sailplane or small aircraft is in the storage structure, and a second set of frame members hingedly mounted in part to the upper frame support and partly to first set of frame members. The second set of frame members are located substantially where the front or cockpit of the plane is located and in front of the wings. Panels covering the first and second frame members and enclosing the structure are mounted to the first and second frame members. A cable, chain or like mechanism operated by a winch raises the second set of hinged frame members together with the cover panels mounted thereon to allow the sailplane to be placed into the storage structure. The winch also lowers the second set of frame members to close the structure and enclose the plane therein. The winch is powered by a battery that is charged by a solar panel associated with the structure.

19 Claims, 15 Drawing Sheets

FIG 21
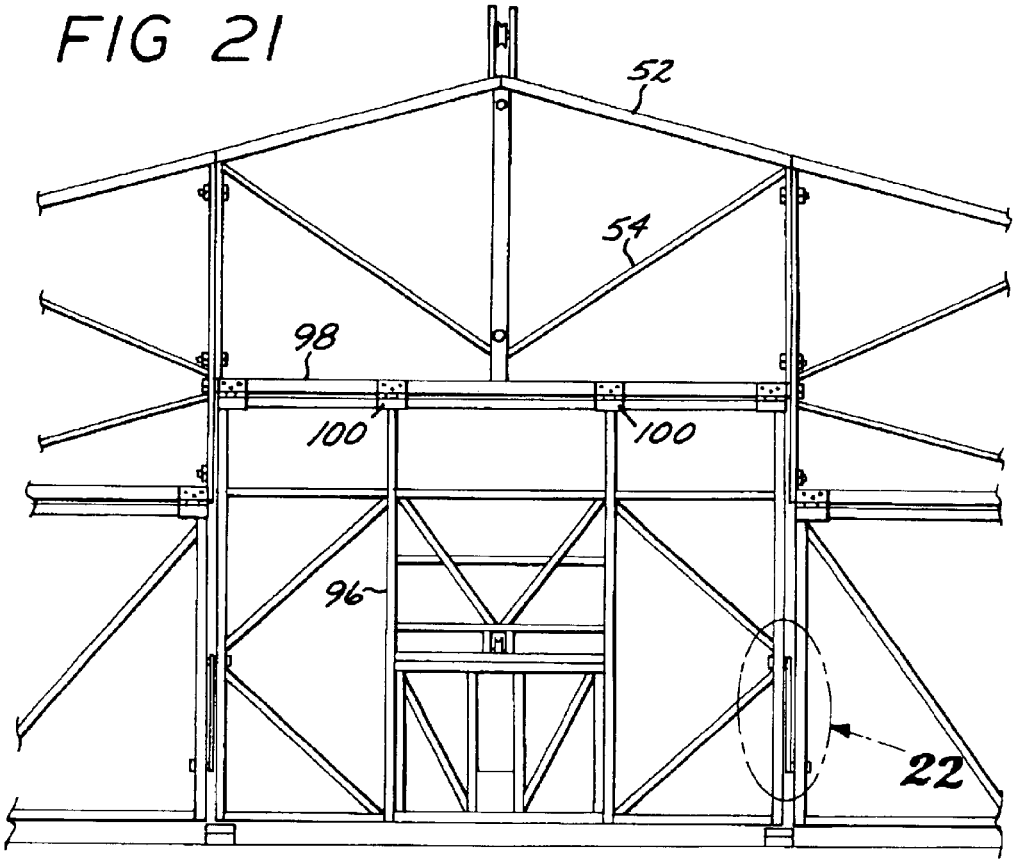
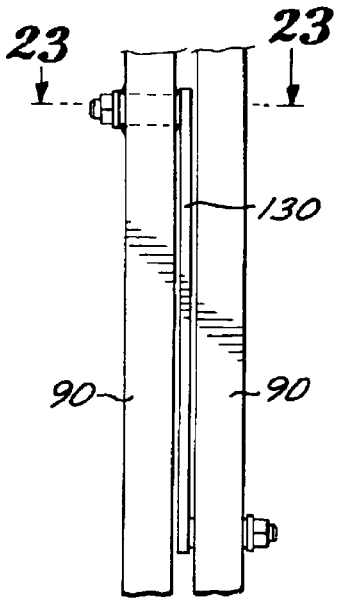
FIG 22
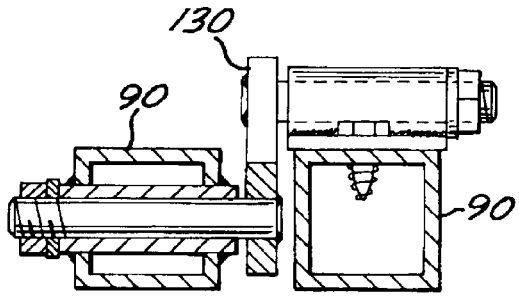
FIG.23

STORAGE STRUCTURE FOR SAILPLANES AND SMALL AIRCRAFT

BACKGROUND OF THE INVENTION

1. Field of the Invention

The present invention is in the field of structures designed to house sailplanes and small aircraft. More particularly, the present invention pertains to a structure which is specifically suited for protecting sailplanes and other small aircraft from exposure to the elements.

2. Brief Description of Background Art

It is well known that small aircraft is best stored in hangars or like buildings where the aircraft is protected from exposure to the elements. This is particularly true for sailplanes (also known as gliders) which in modern times are usually made from fiber glass, carbon fiber or like synthetic material. It is known that these synthetic materials are severely damaged by prolonged exposure to the sun. However, storage space in hangars or like structures is usually limited in the airports and airfields where sailplanes are normally operated, and when storage space is available it is usually expensive. Sailplanes are often moved from one airfield to another or are retrieved from off-airfield landings in covered trailers in which the sailplane can be stored and transported but only if the wings are first disassembled from the fuselage. For this reason many sailplane owners or operators have specifically dimensioned trailers for each sailplane.

In order to avoid exposing sailplanes, especially sailplanes made from fiberglass, carbon fiber or like synthetic material to the elements the owners or pilots usually remove the wings from the sailplane and store the sailplane in its covered trailer even when there is no intention or need to move the disassembled sailplane from one location to another. However, as it is known by those familiar with sailplane operations, sailplane wings are heavy, and removing them can be burdensome and time-consuming, especially when this operation is performed by one person. Reassembling the wings to the sailplane to make it airworthy again is equally burdensome and time consuming. Moreover, the reassembly of the wings and reconnection of the control surfaces must be performed with absolute precision with no room for error, since failure of properly attaching the wings to the fuselage, and/or failure of properly connecting the control surfaces is likely to cause serious and possibly fatal crashes.

The present invention provides a solution to the problem of disassembling sailplanes for storage just to protect them from the elements, and provides convenient and relatively inexpensive storage space for sailplanes and other small aircraft.

SUMMARY OF THE INVENTION

It is an object of the present invention to provide storage space for housing a sailplane or like small aircraft whereby the sailplane or aircraft is protected from the elements.

It is another object of the present invention to provide storage space for a sailplane or like small aircraft that is relatively inexpensive to manufacture.

It is still another object of the present invention to provide storage space for a sailplane or like small aircraft that can be assembled at the site of usage from pre-fabricated parts.

It is yet another object of the present invention to provide storage space for a sailplane or like small aircraft which is easy to operate.

It is a further object of the present invention to provide storage space for a sailplane or like small aircraft that is operated by electric power without being dependent on a power grid.

These and other advantages are attained by a storage structure or hangar which has a substantially T-shaped pre-fabricated truss or upper frame support anchored to the ground at a plurality of locations, first set of frame members mounted immovably to the truss or upper frame support in areas where the fuselage and tail and the two wings are located when the sailplane or small aircraft is in the storage structure, and a second set of frame members hingedly mounted in part to the truss or upper frame support and partly to first set of frame members. The second set of frame members are located substantially where the front or cockpit of the plane is located and in front of the wings. Panels covering the first and second frame members and enclosing the structure are mounted to the first and second frame members. A cable, chain or like mechanism operated by a winch raises the second set of hinged frame members together with the cover panels mounted thereon to allow the plane to be placed into the storage structure. The winch also lowers the second set of frame members to close the structure and enclose the plane therein.

The foregoing and other objects and advantages attained by the present invention will become readily apparent from the following description taken together with the appended drawings where like numerals indicate like parts.

BRIEF DESCRIPTION OF THE DRAWINGS

FIG. 21 is a front plan view of the front of the hangar of the present invention, the view showing the second set of frame members which enclose the cockpit, attached to the truss or upper frame support.

FIG. 22 is an enlarged view of the area indicated 22 in FIG. 21.

FIG. 23 is a cross-sectional view taken on lines 23,23 of FIG. 22.

DETAILED DESCRIPTION OF THE PREFERRED EMBODIMENT

The following specification taken in conjunction with the drawings sets forth the preferred embodiment of the present invention in such a manner that any person skilled in the art can use the invention. The embodiment of the invention disclosed herein is the best mode presently contemplated by the inventor, although it should be understood that various modifications can be accomplished within the parameters of the present invention.

Referring now to the appended drawing figures, a preferred embodiment of the storage structure, storage unit or hangar 50 of the present invention is disclosed. It should be noted at the outset that the storage structure or hangar 50 of the present invention is designed primarily for storage of sailplanes which are also known as gliders. Sailplanes or gliders typically have small cockpits for one or two persons and the cockpits tend to be relatively low to the ground. Sailplanes or gliders also typically have long wings and a relatively narrow fuselage. All of the foregoing is especially true for the sailplanes that are made from fiberglass, carbon fiber or like synthetic material. Thus, the storage structure or hangar 50 of the present invention is primarily dimensioned for the housing of sailplanes, and in this specification the preferred embodiment of the storage structure or hangar 50 is shown and described in connection with the housing of a single sailplane. However, the invention is not so limited and the storage structure 50 of the invention can also be readily adapted for the housing and storage of other small aircraft, for example a small power plane.

Figure 9:
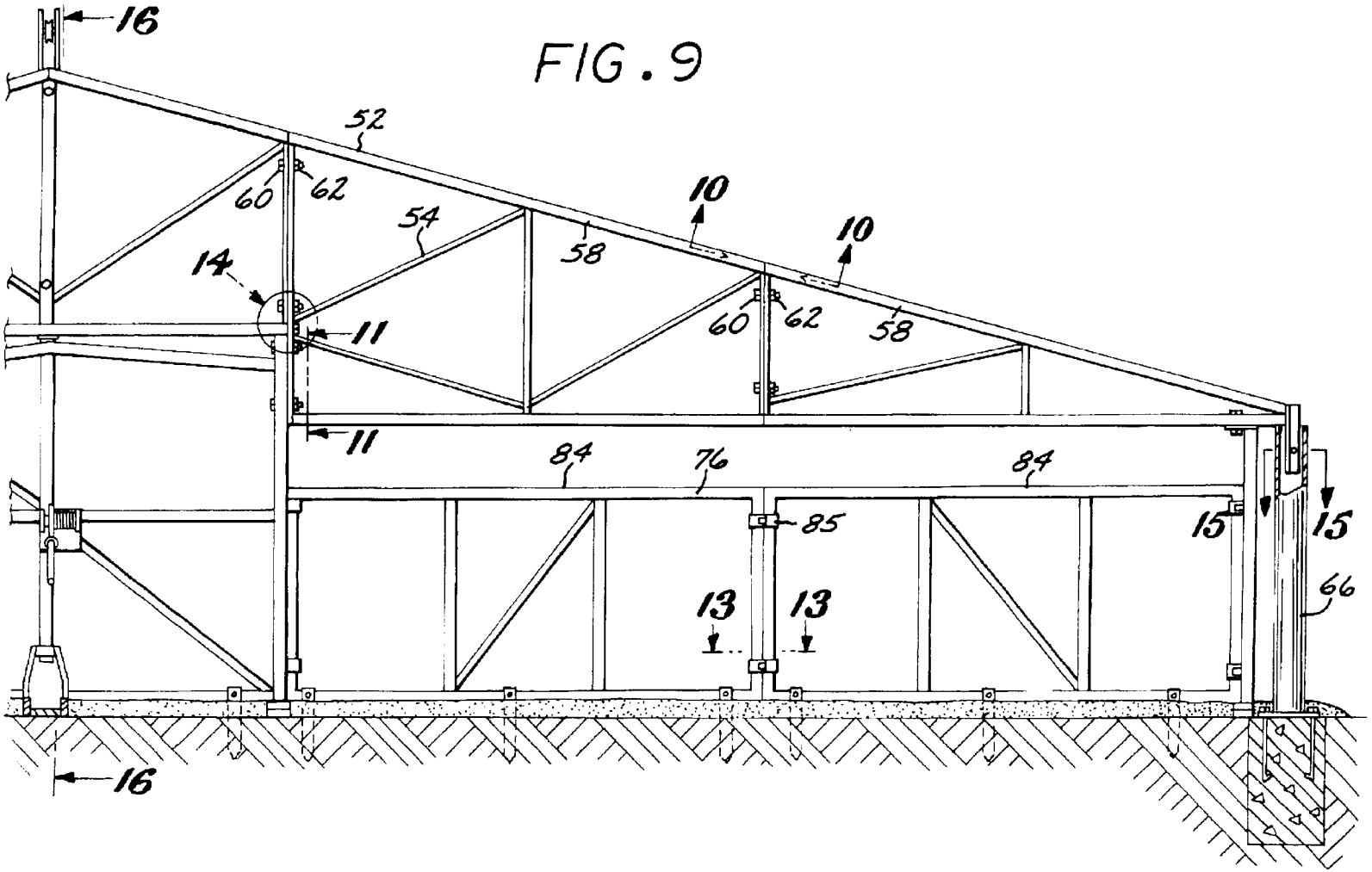
FIG. 9 is a cross-sectional view, taken on lines 9,9 of FIG. 8.
Figure 10:
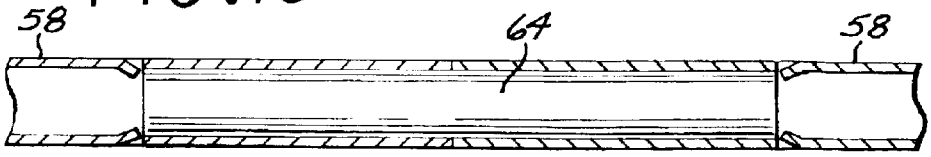
FIG. 10 is a cross-sectional view taken on lines 10,10 of FIG. 9, the view showing the juncture of two members of rectangular cross-section which are part of the truss.
Figure 14:
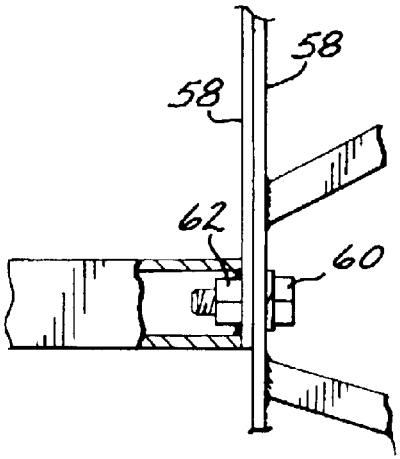
FIG. 14 is an enlarged view taken of the area indicated by 14 on FIG. 9, the view showing connection of two members which are part of the truss or upper frame support.
Figure 15:
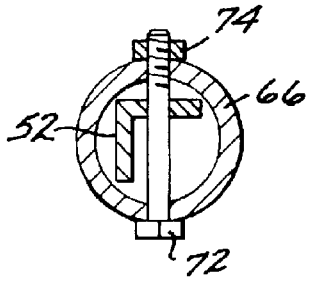
FIG. 15 is a cross-sectional view taken on lines 15,15 of FIG. 9, the view showing connection of the truss to an anchor post.

It is an important feature of the storage structure or hangar 50 of the present invention that it can be readily assembled from pre-fabricated parts at a desired site, such as an airfield, where sailplanes operate. Principal components or parts of the storage structure or hangar 50 include a substantially T-shaped truss or upper frame support 52 that is best shown by itself in FIG. 7. Conceptually, the T-shaped truss or upper frame support 52 has a frontal part 54 to which structures housing the wings and cockpit of a sailplane are mounted, and a rear part 56 to which structures housing the fuselage are mounted. The T-shaped truss or upper frame support 52 is advantageously pre-fabricated from steel in several sections and is assembled at the desired site from the several pre-fabricated sections. In the presently preferred embodiment the frontal part 54 is assembled from five pre-fabricated sections 58, and the rear part 56 is assembled from two pre-fabricated sections 58. Preferably, as in the herein described preferred embodiment each pre-fabricated section 58 is made of steel bars of substantially rectangular cross-section which are welded together to form the respective pre-fabricated section 58. As is shown in FIGS. 9 and 14, the pre-fabricated sections 58 are attached to one another by bolts 60 and nuts 62. Moreover, adjoining linearly lined up bars of the sections 58 are linked with a reinforcing internal steel tube or bar 64, shown in FIG. 10. FIGS. 7, 9, 17 and 18 illustrate that the T-shaped truss 52 is attached to and is supported in its elevated position by three vertical posts 66 which are embedded in the ground 68, preferably in concrete 70. The cross-sectional view of FIG. 15 illustrates in detail the mounting of the T-shaped truss 52 into the vertical post 66 by bolt 72 and nut 74.

Figure 7:
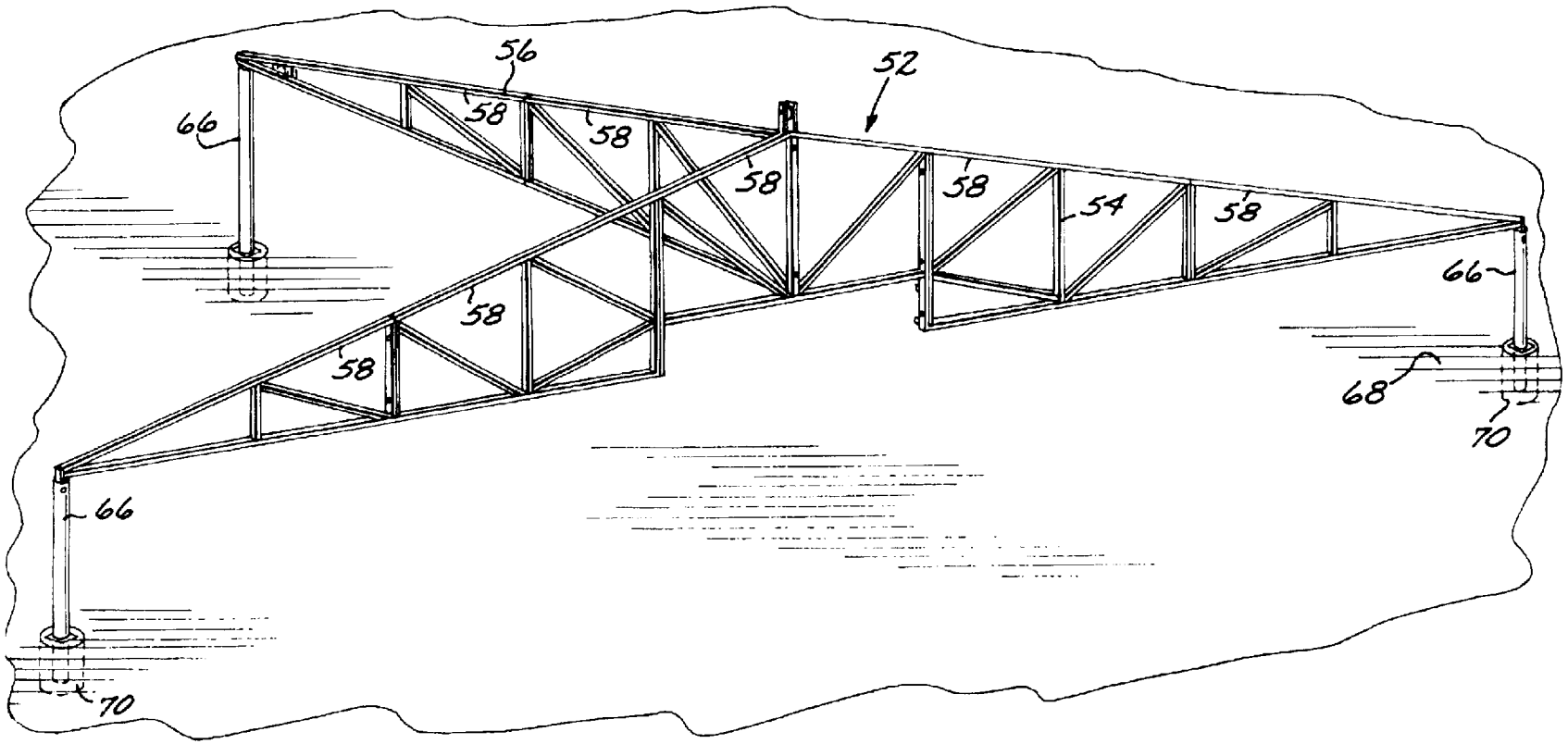
FIG. 7 is a perspective view of the substantially T-shaped truss or upper frame support of the storage structure or hangar of the present invention.
Figure 7A:
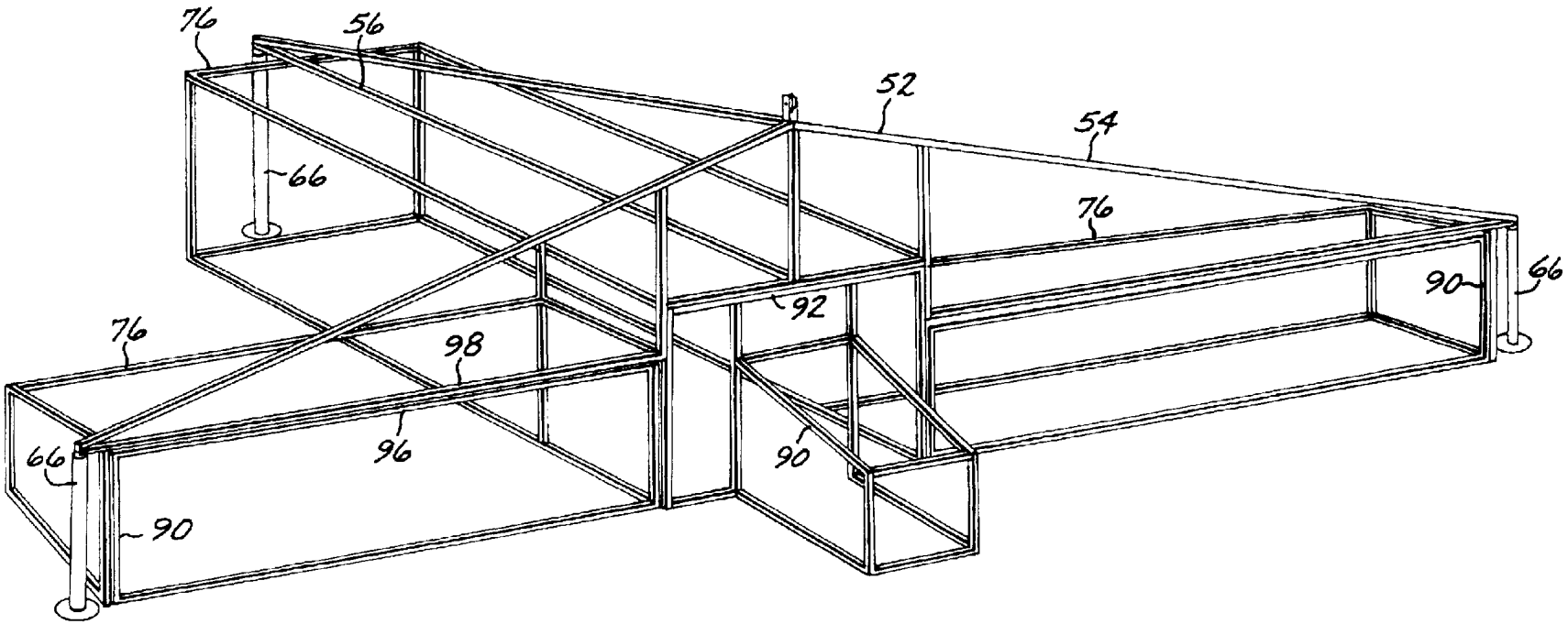
FIG. 7A is a schematic, simplified perspective view of the substantially T-shaped truss or upper frame support of the storage structure or hangar and of the first and second sets of frame members attached to the truss, without showing any cross-bracing members or panels covering the frame members.
Figure 11:
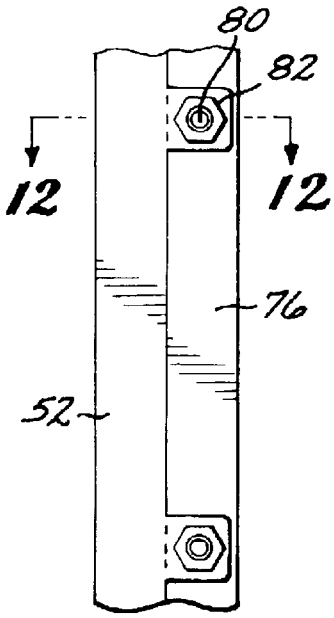
FIG. 11 is a plan view taken on lines 11,11 of FIG. 9, the view showing attachment of the truss or upper frame support to the first set of frame members.
Figure 12:
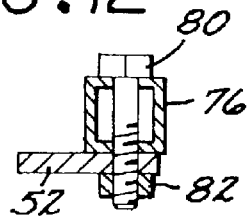
FIG. 12 is a cross-sectional view taken on lines 12,12 of FIG. 11.
Figure 13:
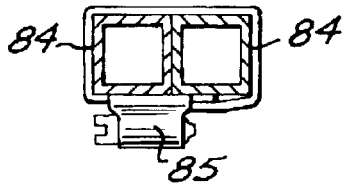
FIG. 13 is a cross-sectional view taken on lines 13,13 of FIG. 9, the view showing the attachment of two adjoining frame members.
Figure 20:
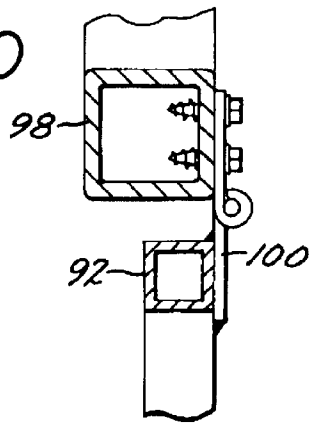
FIG. 20 is a view taken on lines 20,20 of FIG. 19, the view showing a hinge in detail.
Figure 19:
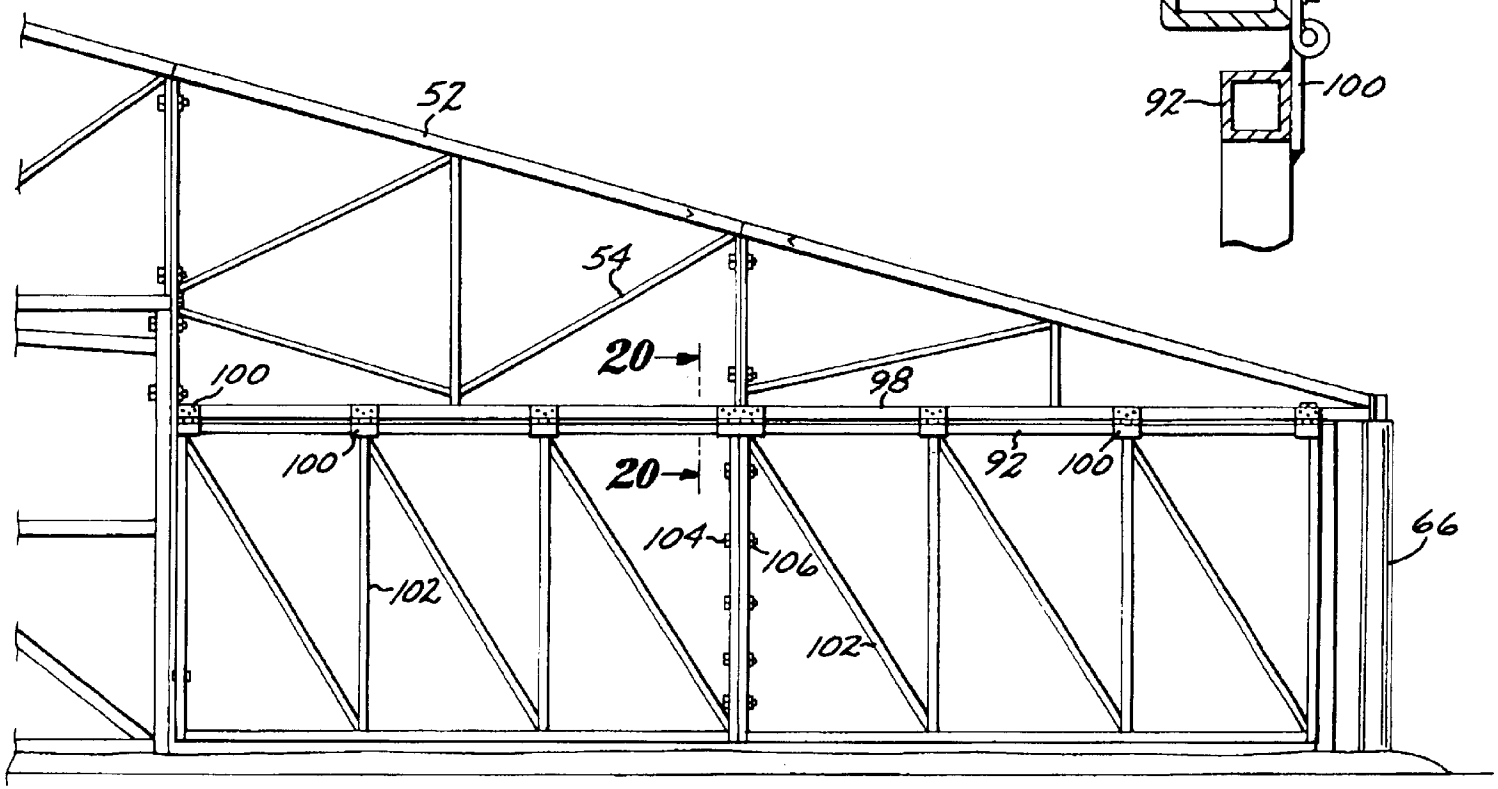
FIG. 19 is a front plan view of the right half of the hangar of the present invention, the view showing the second set of the hinged frame members attached to the truss.
Figure 24:
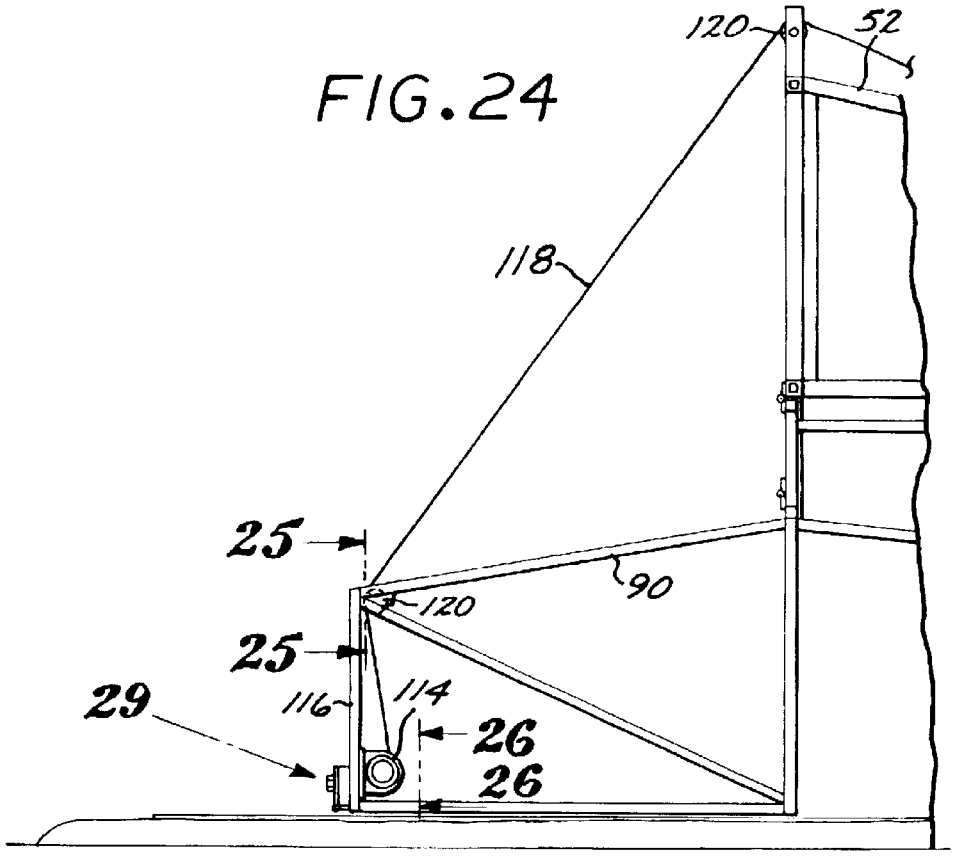
FIG. 24 is a diagrammatic side view of the truss and of the second set of hinged frame members capable of enclosing the cockpit part of a plane, the view showing the cable and winch mechanism that raises and lowers the hinged frame members.
Figure 25:
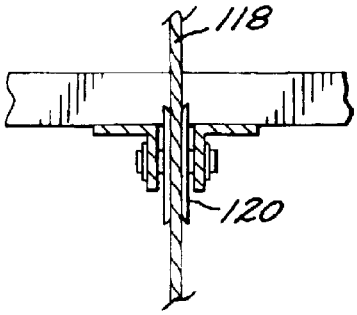
FIG. 25 is a cross-sectional view taken on lines 25,25 of FIG. 24.
Figure 26:
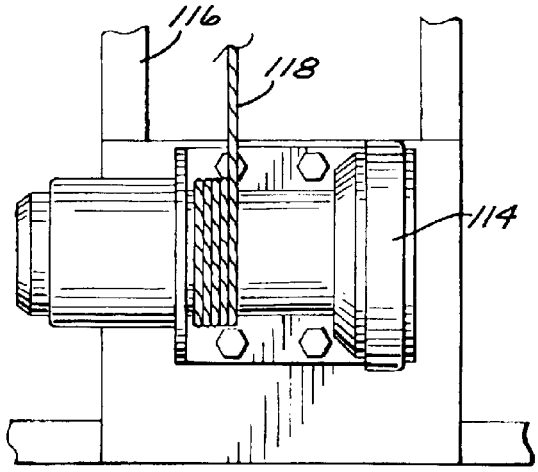
FIG. 26 is a view taken on lines 26,26 of FIG. 24.
Figure 27:
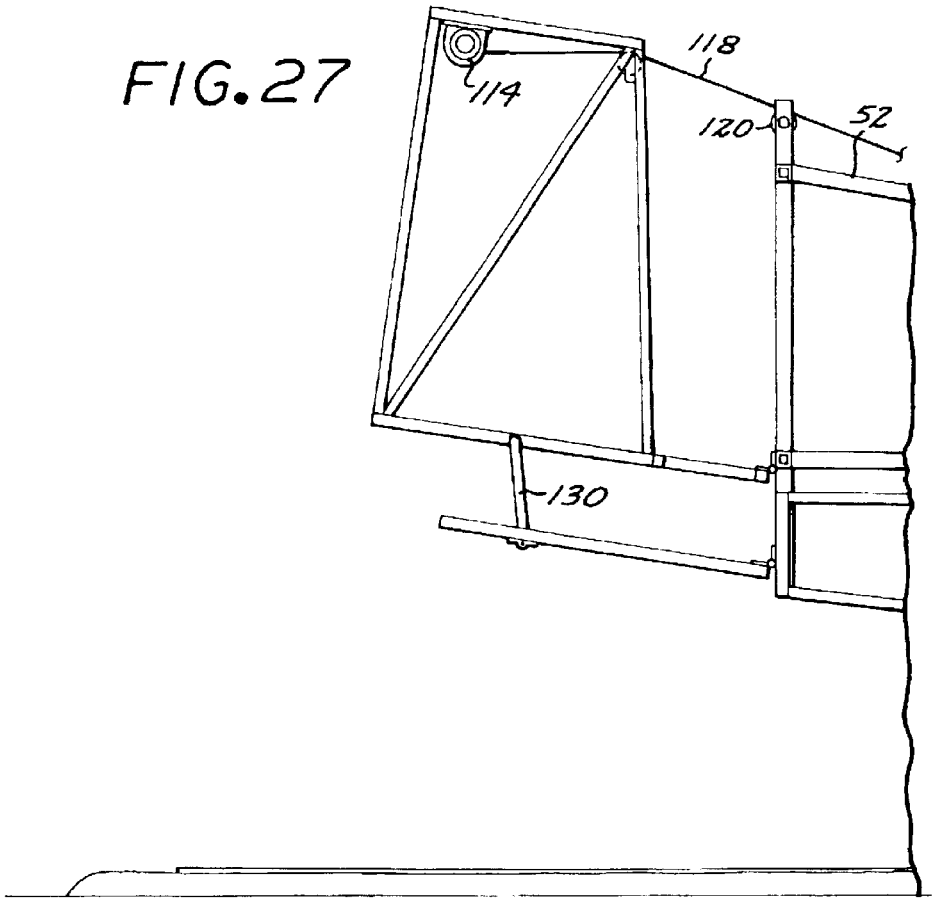
FIG. 27 is a diagrammatic side view showing the raised position of the second set of hinged frame members capable of enclosing the cockpit part of a plane.

The simplified diagrammatic view of FIG. 7A illustrates conceptually the mounting and location of first and second set of frame members to the substantially T-shaped truss 52. FIG. 7A is simplified for illustration, because it does not show vertical and diagonal reinforcing bars that form part of these structures. However, the vertical and diagonal reinforcing bars are amply illustrated in other drawing figures. The first set of frame members 76 rests on the ground and is also attached to the truss 52. FIGS. 11 and 12 show that the truss 52 includes tabs 78 that are mounted with bolts 80 and nuts 82 to the first set of frame members 76. The first set of frame members 76 is also preferably pre-fabricated in multiple sections 84 and in the preferred embodiment these sections are attached to one another by the hose clamps 85, as shown in detail by FIG. 13. The first set of frame members 76 has no moving parts in the assembled storage structure or hangar 50 of the invention, and serve to support cover members or panels 86 which actually enclose a sailplane 88 in the storage structure or hangar 50 of the invention and protect it from rain, solar rays and other exposure to the elements. The second set of frame members 90, also shown conceptually in FIG. 7A, is attached in part to the truss 52 and in part to the first set of frame members 76. More specifically, the second set of frame members 90 include parts 92 which are hingedly attached to a frontal horizontal member 94 of the truss 52 and parts 96 which are hingedly attached to frontal horizontal members 98 of the first set of frames 76. This attachment is by hinges 100 and is perhaps best shown in FIGS. 19 and 21 while FIG. 20 shows the hinge 100 in detail. The second set of frame members 90 is also preferably pre-fabricated from several sections 102, as shown in FIG. 19 for the part that is included in the right side of the hangar 50 and which provides the front cover for one wing of the sailplane 88 to be stored in the hangar 50. The sections 102 shown in FIG. 19 are attached to one another by nuts 104 and bolts 106, although other types of attachment may also be used.

Generally speaking, connections or mounting between mechanical parts such as welding, bolting, using hose clamps or other types of clamps, U-bolts or types of mechanical fasteners are well known in the art. In many instances, which will be readily apparent to those skilled in the art in light of the present disclosure, the herein described and other types of known mechanical fastening devices and means are interchangeable or equivalent. For this reason, a person of ordinary skill in the art may be able to build on the basis of the present disclosure the hangar or storage structure 50 of the present invention utilizing different types of mechanical fasteners than the ones specifically described in connection with the preferred embodiment. For example, hose clamps may be substituted with bolts and nuts or welding. Bolts, nuts and other type of mechanical fasteners can, in many instances, be replaced by welding the respective parts together and such apparent variations or modifications of attaching parts together are within the scope of the present invention.

Figure 8:
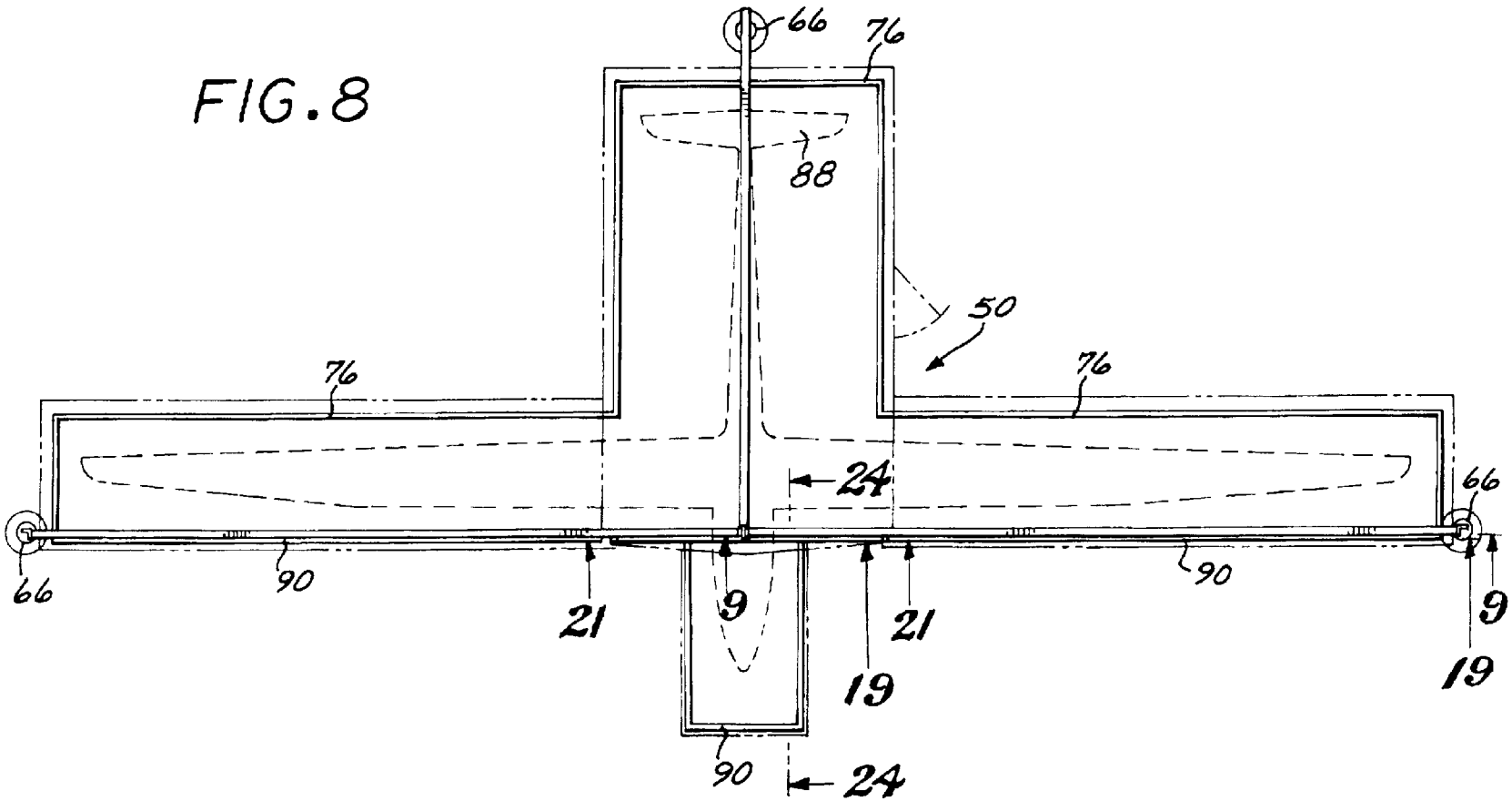
FIG. 8 is a diagrammatic top plan view showing the location of the first and second frame members which form the walls of the storage structure or hangar of the present invention.

FIG. 8 also shows the location of first and second sets of frame members 76 and 90 in the storage structure or hangar 50 of the present invention relative to the truss 52 and a sailplane 88 which may be stored in the structure 50. FIGS. 1 through 4 shows the structure or hangar 50 with the cover members or panels 86 mounted on the first and second sets of frame members 76 and 90. A door 108 is located in one of the sections 84 of the first set of frame members 76 to allow access to the interior of the storage structure or hangar 50.

Figure 34:
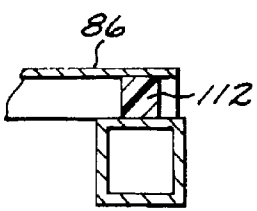
FIG. 34 is a cross-sectional view taken on lines 34,34 of FIG. 33.
Figure 33:
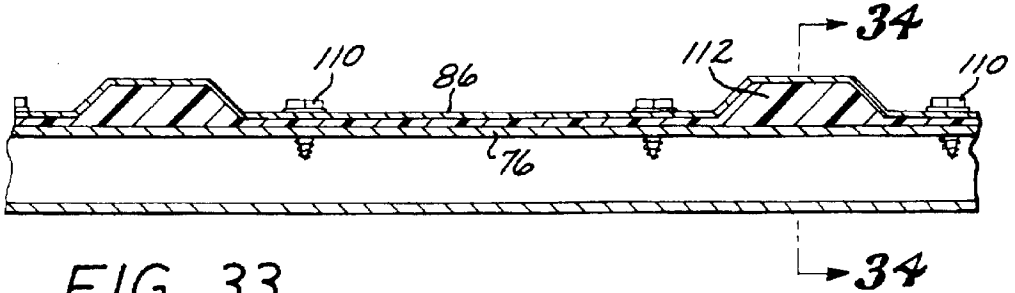
FIG. 33 is a cross-sectional view taken on lines 33,33 of FIG. 1, the view showing attachment of corrugated metal siding to the first set of frame members.
Figure 35:
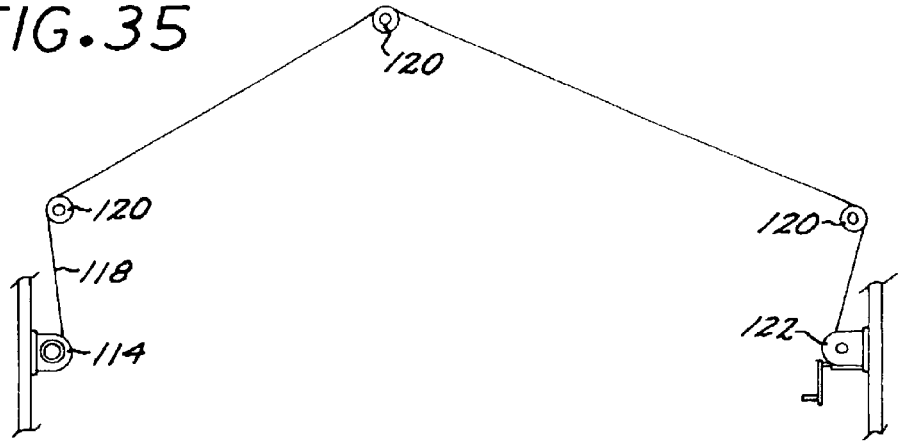
FIG. 35 is a diagrammatic view showing a cable, electric and hand winches utilized for raising the hinged frame members of the storage structure or hangar of the present invention.

The cross-sectional views of FIGS. 33 and 34 show in detail the mounting of the cover member or panel 86 to the frame members 76 and 90. The cover members or panels 86 of the presently preferred embodiment comprise corrugated metal plates 86, which are attached to the frames 76 and 90 with self-tapping sheet metal screws 110. Foam 112 is located between the corrugated metal panels 86 and the frame members 76 and/or 90 to provide insulation. Instead of corrugated metal plates 86, wood or plastic panels could also be attached to the members 76 and/or 90 to enclose the sailplane 88 and protect it from the elements.

Figures 16, 17, 18:
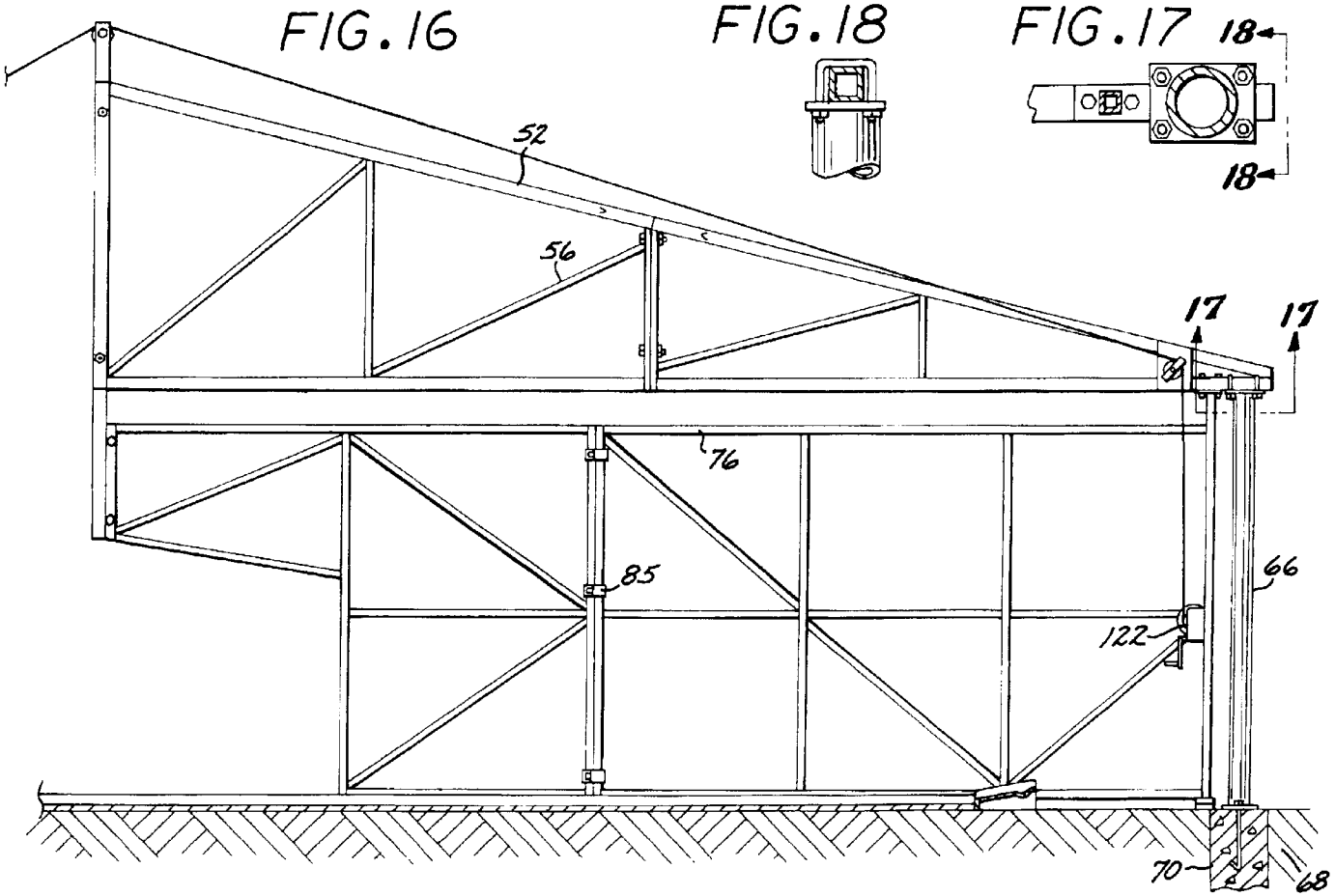
FIG. 16 is a cross-sectional view, taken on lines 16,16 of FIG. 9.
FIG. 17 is a view taken on lines 17,17 of FIG. 16, the view showing connection of the truss to an anchor post.
FIG. 18 is a view taken on lines 18,18 of FIG. 17.
Figure 36:
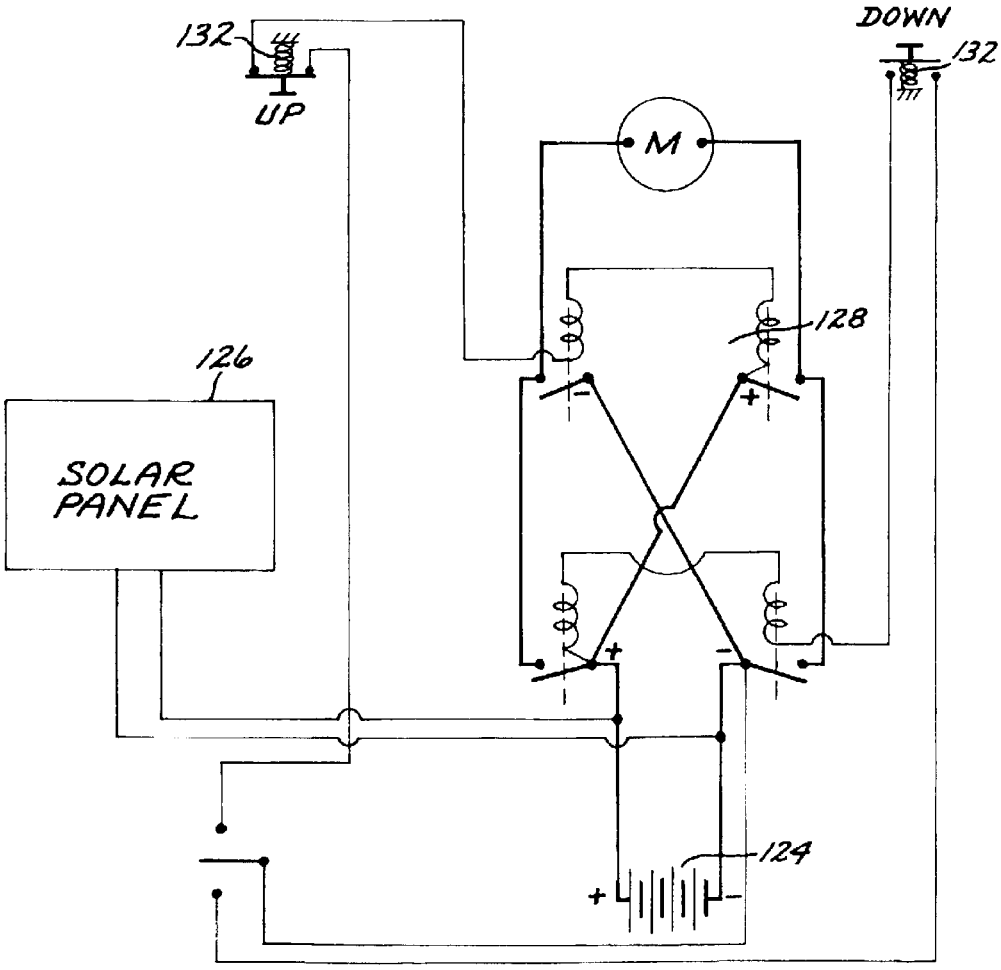
FIG. 36 is a circuit diagram of the electric components of the storage unit of the present invention.

Referring now primarily to FIGS. 3, 4 and 21 through 28, opening and closing the storage unit or hangar 50 of the present invention is disclosed. A winch 114 is mounted to a vertical member 116 of the second set of frame 90 that serves as cover for the cockpit of the sailplane 88. A cable or wire 118 is attached to the winch 114 and is lead through pulleys 120 to a second winch 122 in the rear of the structure 50. The second winch 122 is shown in FIG. 16. In the preferred embodiment the winch 114 is powered by a 12 volt battery 124. The battery 124 is charged by a solar panel 126 that is placed on one of the cover plates 86. The battery 124 and solar panel 126 are shown in FIG. 36. Rotation of the winch 114, powered by the battery 124 winds-up or releases the cable 118 depending on the polarity of the current which is supplied to it through a switch 128 shown in FIG. 36. The second winch 122 of the preferred embodiment is hand operated and is intended for use only when for some reason or another the first winch 114 is inoperative. In alternative embodiments both winches may be electrically powered and/or may be powered by 110 AC current rather than by a D.C. battery.

When the winch 114 is powered through the switch 128 to take up the cable 118, the hinged second set of frame members 90 are lifted so as to allow the movement of a sailplane 88 into or out of the hangar 50. More specifically, first that part of the frame members 90 is lifted together with the corresponding cover panels 86 which encloses the cockpit of the sailplane 88. The winch 114 rides up on the cable 118 together with the frame member 116 to which it is mounted. Sides of the frame members 90 are connected with a link 130 to the respective the frame members 90 that are hingedly mounted to the frontal horizontal members 98 and enclose the wings of the sailplane 88. Details of the operation of the link 130 that in essence links the cockpit cover door with the wing cover door, are shown in FIGS. 22, 23, 27, and 28. As these figures disclose, the link 130 is mounted to the respective frames members 90 in such a manner that the frame members 90 can pivot relative to the link 130. Thus, as the frame members 90 forming the cockpit cover are lifted, the link 130 also lifts the frame members 90 forming the front cover for the wings of the sailplane 88. When the polarity of current is reversed by the switch 128, the winch 114 unrolls cable 118 and the frame members 90 forming the cockpit and wing covers are lowered, thereby closing the structure 50 and enclosing the sailplane 88 that may be present in the storage structure or hangar 50. Limit switches 132 shown in FIG. 36 prevent lifting the hinged frame members 90 too high or lowering them too low and therefore prevent damage to the structure.

Figure 1:
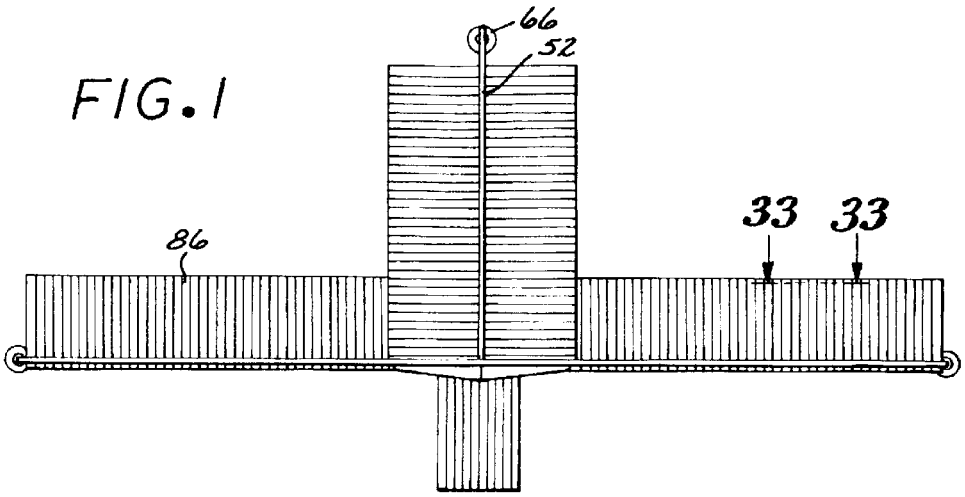
FIG. 1 is a top plan view of the storage structure or hangar of the present invention.
Figure 2:
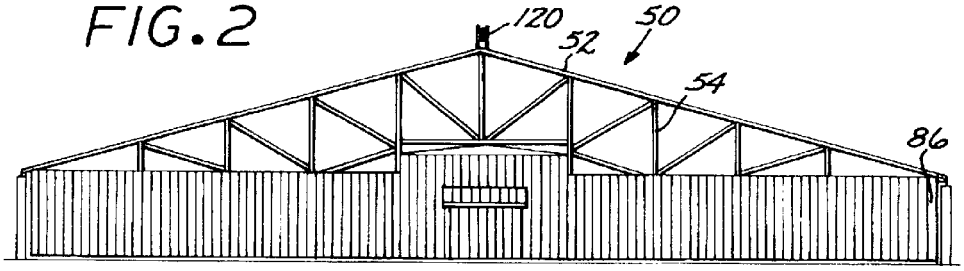
FIG. 2 is a front plan view of the storage structure or hangar of the present invention.
Figure 3:
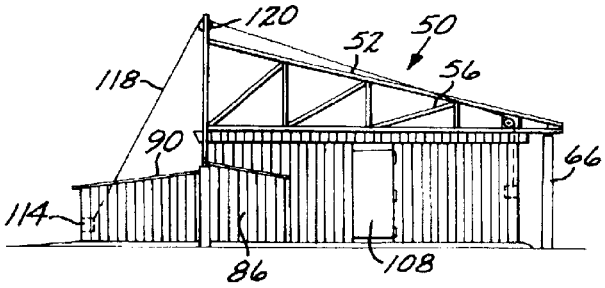
FIG. 3 is a side view of the storage structure or hangar of the present invention, the view showing a second hinged set of frame members in a down position whereby the storage structure is closed.
Figure 4:
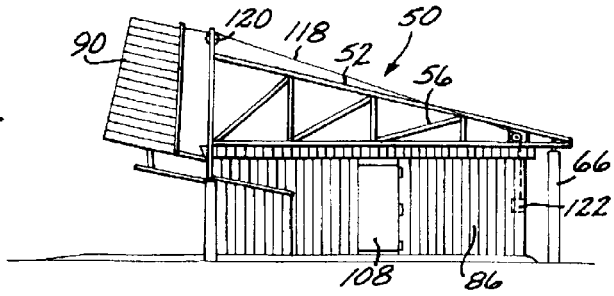
FIG. 4 is a side view of the storage structure or hangar of the present invention, the view showing a second hinged set of frame members in a raised position whereby the storage structure is open.
Figure 5:
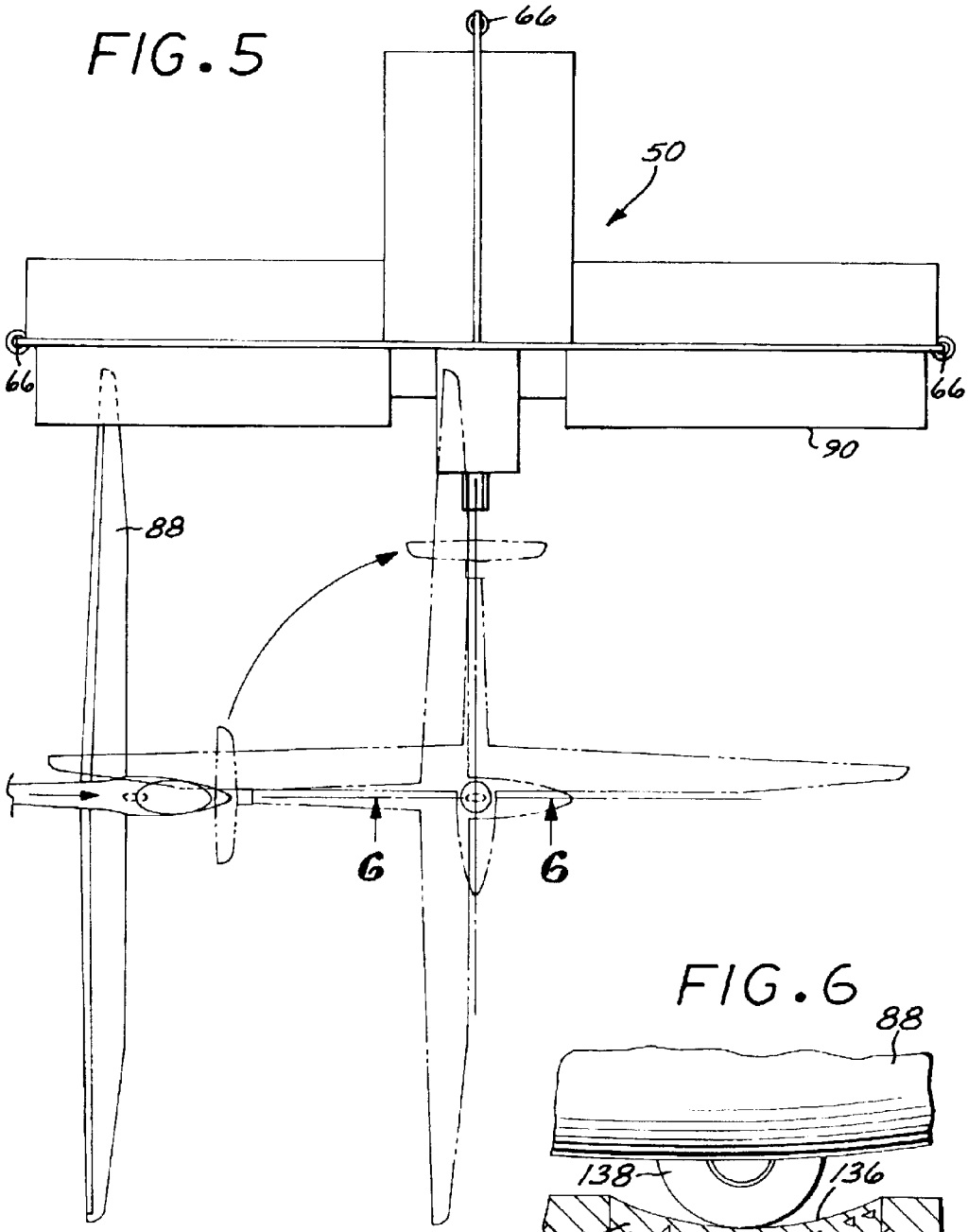
FIG. 5 is a diagramatic top plan view of the storage structure or hangar of the present invention, the view showing a second hinged set of frame members in a raised position whereby the storage structure is open, and a sailplane is being maneuvered into placement within the structure.
Figure 6:
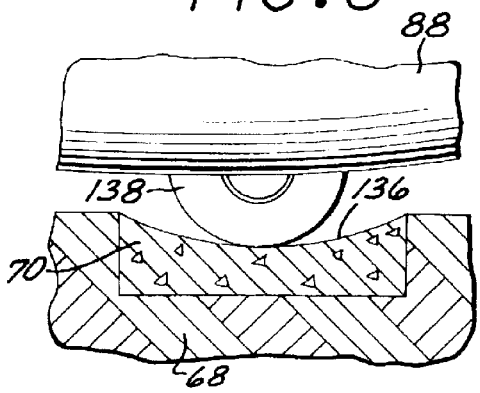
FIG. 6 is an enlarged view of an area shown in FIG. 5.

FIGS. 5, 6 and 30 through 32 disclose other features of the storage unit or hangar 50 of the present invention which further facilitate the movement of a sailplane 88 into and out of the storage structure 50. Specifically FIGS. 5 and 6 disclose a substantially circular indentation 136 or shallow dent in concrete 70 embedded in the ground 68 at a distance from the front of the structure 50 which substantially corresponds to the length of the wing of the sailplane 88 that is to be stored in the structure 50. This makes it easy for a person (not shown) to push a sailplane 88 with its fuselage parallel with the front of the storage structure or hangar 50 at the proper distance from the structure 50 until the front wheel 138 of the sailplane 88 rests in the indentation 136. Then the sailplane 88 is pivoted 90 degrees on its front wheel 138, as shown in FIG. 5, before its is pushed into the structure 50 for storage.

Figure 30:
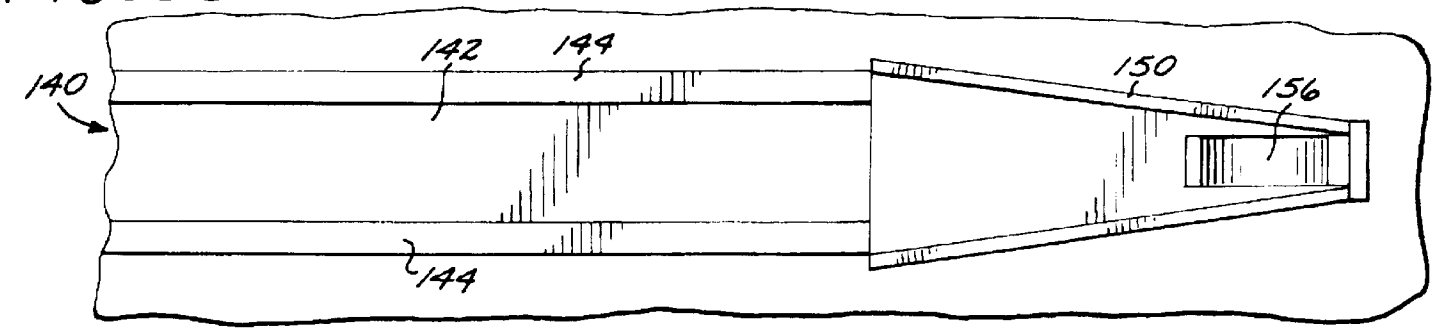
FIG. 30 is a diagrammatic top view of a channel or trough and a ramp utilized for moving a plane in and out of the storage structure or hangar of the present invention.
Figure 31:
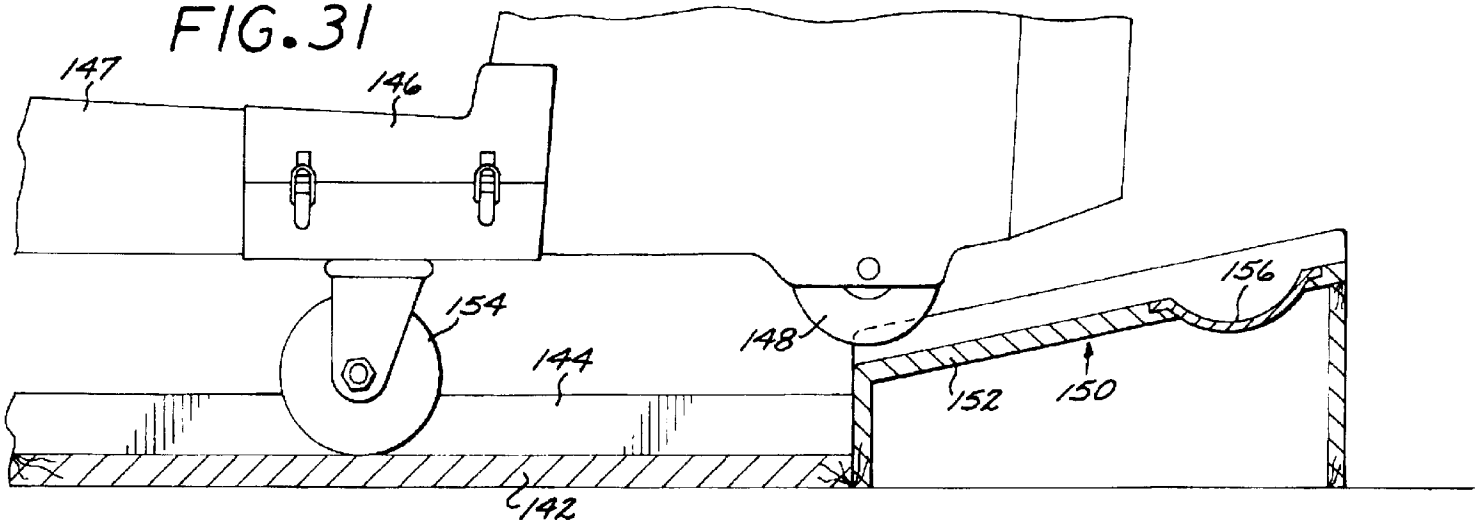
FIG. 31 is a diagrammatic cross-sectional view of a channel or trough and a ramp utilized for moving a plane in and out of the storage structure or hangar of the present invention, the view also showing a plane as it is being moved.
Figure 32:
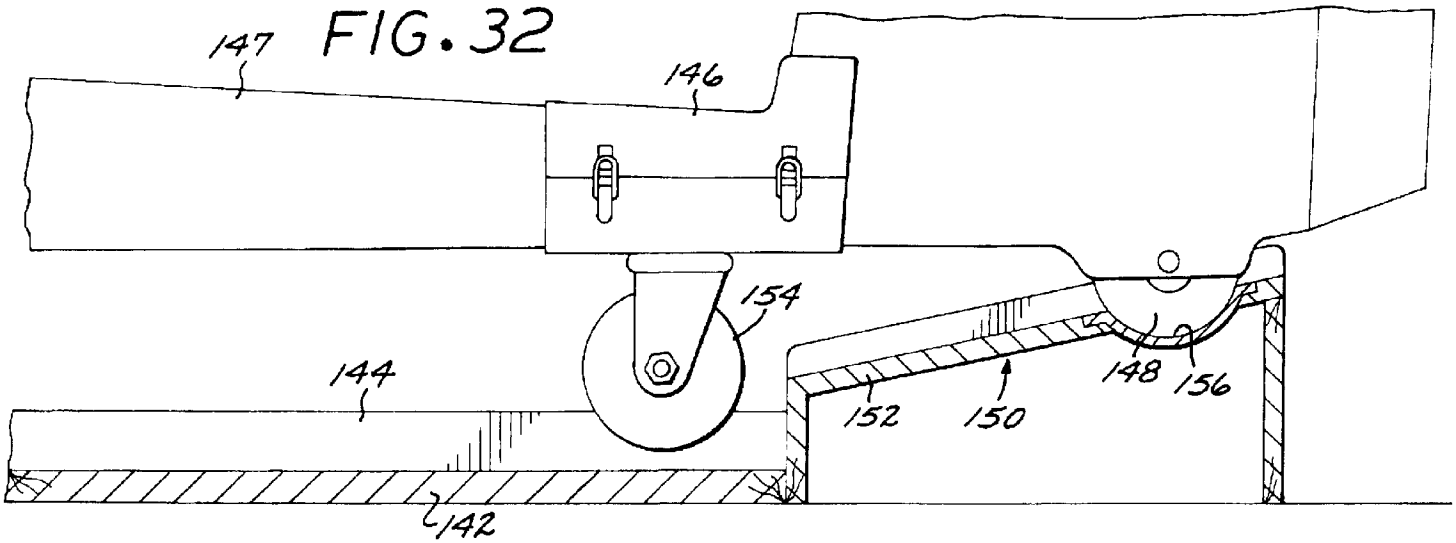
FIG. 32 is a diagrammatic cross-sectional view of a channel or trough and a ramp utilized for moving a plane in and out of the storage structure or hangar of the present invention, the view also showing a plane positioned for storage in the storage structure.

FIGS. 30 through 32 disclose a trough 140 formed inside the structure 50 and in alignment with the rear part 56 of the T shaped frame support 52. In the presently preferred embodiment the trough 140 is comprised of a 4" by 6" wooden board 142 that is disposed flat on the ground 68 and of two 4" by 4" or 4" by 6" wooden boards 144 positioned on their respective edges and attached to the 4" by 6" board 142 by wood screws (not shown). In alternative embodiments the trough 140 may be made of metal or plastic or of any combination of wood, metal and plastic materials.

As is known by those who are familiar with sailplane operations, sailplanes are frequently moved around by attaching a tail dolly 146 to the rear part of the fuselage 147, as is shown in FIGS. 31 and 32. The tail dolly 146 causes the tail wheel 148 of the sailplane 88 to be lifted off the ground 68, however the tail dolly 146 must not be attached to the sailplane 88 during flight because it significantly changes the weight and balance and is likely to cause a serious accident. Nevertheless use of the tail dolly 146 greatly facilitates transportation of the sailplane 88 on the ground, as for example when the sailplane 88 is moved from the hangar 50 to a take-off line, or when it is returned to the hangar 50 after flight. It is also customary to remove the tail dolly 146 from the fuselage 147 when the sailplane 88 is stored or hangared, principally because during prolonged storage the pressure by the straps and buckles attaching the tail dolly 146 to the fuselage 147 may discolor or damage the delicate synthetic material of the sailplane 88.

To facilitate the movement of a sailplane 88 with a tail dolly 146 into and out of the storage structure or hangar 50 of the present invention and to avoid the need for lifting the relatively heavy tail of the sailplane 88 when the tail dolly 146 is removed, a ramp 150 is placed at the end of the trough 140 in a location where the tail wheel 148 of the sailplane 88 is to be located. The sloping part 152 of the ramp 150 begins high enough so that the tail of the sailplane 88 clears it as the sailplane 88 is pushed into the hangar 50 with the wheel 154 of the tail dolly 146 and the sailplane's front wheel 138 rolling in the trough 140. To store the sailplane 88 and to render it easy to remove the tail dolly 146 the sailplane 88 is moved until its rear wheel 148 rests in an oval depression 156 provided in the ramp 150, as is shown in FIG. 32. In this position the wheel 156 of the tail dolly 146 is lifted off the trough 140 and the tail dolly 146 can be readily removed, and also reassembled when it is desired to move the sailplane 88 out of the storage unit 50.

Figure 29:
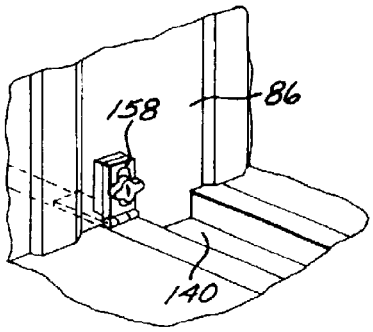
FIG. 29 is an enlarged view of the are indicated at 29 on FIG. 24, the view showing a locking mechanism for the storage unit of the present invention.
Figure 28:
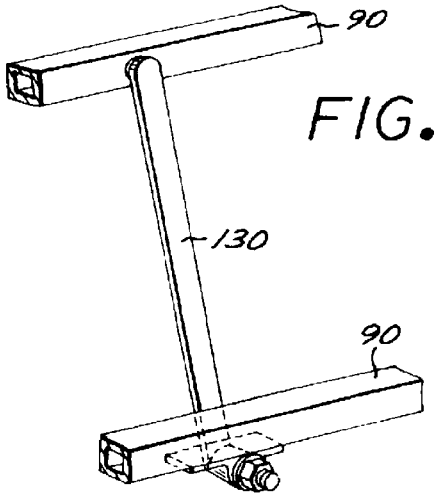
FIG. 28 is a diagrammatic perspective view showing mechanical connection between the hinged frame members normally covering the cockpit and hinged frame members normally covering the wing of a plane in the storage unit of the invention.

FIG. 29 illustrates an optional lock 158 which may be attached to one of the 4" by 4" or 4" by 6" boards forming the trough 140 and to a panel 86 to prevent unauthorized opening of the structure or hangar 50. Another lock (not shown) is usually provided in the door 108.

As noted above the storage structure or hangar 50 is preferably made from pre-fabricated parts. Although the steps of building the structure 50 should be apparent to those skilled in the art from the foregoing description, the preferred method of construction is briefly described below.

First and preferably a location on the ground 68 is prepared by selecting a suitable flat area, the trough 140 is built from wooden boards and the ground 68 is preferably covered with light gravel (not shown) to cover the base of the structure 50. The vertical posts 66 are embedded in concrete 70 in the ground 68, and the substantially T-shaped truss 52 is mounted to the vertical posts 66. Sections 84 of the first set of frame members 76 are then placed on the ground and mounted to the truss 52, and to each other, as applicable, followed by sections 102 of the second set of frame members 90 mounted with hinges 100 to the truss 52, to each other, and to the first set of frames 76, as applicable. The truss 52 and the frame members 76 and 90 can then be painted if so desired, and if they have not been painted before. Subsequently, the battery 124, the switches, the door 108, winches 114 and 122 and the cover plates or panels 86 and insulating foam 112 are mounted to the structure.

What is claimed is:

1. A storage structure for an aircraft to protect the aircraft from the elements, the storage structure comprising:

an upper frame support anchored to the ground at a plurality of locations;

a first set of frame members mounted immovably to the upper frame support in areas where fuselage, tail and wings of the aircraft are to be located when the aircraft is in the storage structure;

a second set of frame members hingedly mounted partly to the upper frame support and partly to the first set of frame members in areas where the cockpit, nose and wings of the aircraft are to be located when the aircraft is in the storage structure, the first and second set of frame members including cover members mounted to said first and second set of frame members, the hinged second set of frame members capable of occupying a first position where the structure is closed and the cover members completely enclose the aircraft, and a second position wherein the second set of frame members are raised relative to the first position where the structure is open and the aircraft can be moved into and out of the structure;

means for raising the second set of frame members from the first position to the second position thereby opening the structure and for lowering the second set of frame members from the second position to the first position, thereby closing the structure, and wherein the upper frame support comprises a plurality of pre-fabricated sections, said sections being fixedly attached to one another.

2. A storage structure in accordance with claim 1 where the upper frame support is substantially T-shaped.

3. A storage structure in accordance with claim 1 where the means for raising and lowering the second set of frame members comprise a winch and associated cable.

4. A storage structure in accordance with claim 1 where the means for elevating and lowering the second set of frame members are electrically powered.

5. A storage structure in accordance with claim 1 further comprising a plurality of hollow posts anchored in the ground and where the upper frame support is fixedly mounted to the hollow posts.

6. A storage structure in accordance with claim 1 where the cover members comprise corrugated metal panels.

7. A storage structure for an aircraft to protect the aircraft from the elements, the storage structure comprising:

an upper frame support anchored to the ground at a plurality of locations;

a first set of frame members mounted immovably to the upper frame support in areas where fuselage, tail and wines of the aircraft are to be located when the aircraft is in the storage structure;

a second set of frame members hingedly mounted partly to the upper frame support and partly to the first set of frame members in areas where the cockpit, nose and wings of the aircraft are to be located when the aircraft is in the storage structure, the first and second set of frame members including cover members mounted to said first and second set of frame members, the hinged second set of frame members capable of occupying a first position where the structure is closed and the cover members completely enclose the aircraft, and a second position wherein the second set of frame members are raised relative to the first position where the structure is open and the aircraft can be moved into and out of the structure;

means for raising the second set of frame members from the first position to the second position thereby opening the structure and for lowering the second set of frame members from the second position to the first position, thereby closing the structure, and located in the area defined by the first set of frame members, the ramp comprising means for receiving a tail wheel of an aircraft to be stored in the structure and for holding the tail of the aircraft in an elevated position.

8. A storage structure in accordance with claim 7 further comprising a trough leading to the ramp, the trough comprising means for guiding a tail wheel of the aircraft to the ramp.

9. A storage structure for an aircraft to protect the aircraft from the elements, the storage structure substantially conforming to the shape of the aircraft, said storage structure capable of being assembled from pre-fabricated parts and comprising:

a substantially T-shaped upper frame support anchored to the ground at a plurality of locations;

a first set of frame members mounted immovably to the upper frame support in areas where fuselage, tail and wings of the aircraft are to be located when the aircraft is in the storage structure;

a second set of frame members hingedly mounted partly to the upper frame support and partly to the first set of frame members in areas where the cockpit, nose and wings of the aircraft are to be located when the aircraft is in the storage structure, the first and second set of frame members including cover members mounted to said first and second set of frame members, the hinged second set of frame members capable of occupying a first position where the structure is closed and the cover members completely enclose the aircraft, and a second position wherein the second set of frame members are raised relative to the first position where the structure is open and the aircraft can be moved into and out of the structure;

electrically operable winch means for raising the second set of frame members from the first position to the second position thereby opening the structure and for lowering the second set of frame members from the second position to the first position, thereby closing the structure, and wherein the winch means include a winch fixedly attached to the second set of frame members and a cable attached to the winch, the cable also being attached to non-moving part of the structure.

10. A storage structure in accordance with claim 9 wherein the winch means further include a manually operable winch to which the cable is attached, the manually operable winch being attached to a non-moving part of the structure.

11. A storage structure in accordance with claim 9 further including a battery and a solar panel, said battery being operatively connected to the electrically operable winch means to power the electrically operable winch means, and the solar panel being operatively connected to the battery to charge the battery.

12. A storage structure in accordance with claim 9 where the cover members comprise corrugated metal panels.

13. A storage structure in accordance with claim 9 further comprising insulating foam mounted between the corrugated metal panels and the respective first and second frame members to which the panels are attached.

14. A storage structure in accordance with claim 9 further comprising a ramp located in the area defined by the first set of frame members, the ramp comprising means for receiving a tail wheel of an aircraft to be stored in the structure and for holding the tail of the aircraft in an elevated position.

15. A storage structure in accordance with claim 14 further comprising a trough leading to the ramp, the trough comprising means for guiding a tail wheel of the aircraft to the ramp.

16. A storage structure for a sailplane to protect the sailplane from the elements, the storage structure substantially conforming to the shape of the sailplane, said storage structure capable of being assembled from pre-fabricated parts and comprising:

a substantially T-shaped upper frame support anchored to the ground at least at three locations;

a first set of frame members mounted immovably to the upper frame support in areas where fuselage, tail and wings of the sailplane are to be located when the sailplane is in the storage structure;

a second set of frame members hingedly mounted partly to the upper frame support and partly to the first set of frame members in areas where the cockpit, nose and wings of the sailplane are to be located when the sailplane is in the storage structure, the first and second set of frame members including cover members mounted to said first and second set of frame members, the hinged second set of frame members capable of occupying a first position where the structure is closed and the cover members completely enclose the sailplane, and a second position wherein the second set of frame members are raised relative to the first position where the structure is open and the sailplane can be moved into and out of the structure;

electrically operable winch means for raising the second set of frame members from the first position to the second position thereby opening the structure and for lowering the second set of frame members from the second position to the first position, thereby closing the structure, the winch means including a winch fixedly attached to the second set of frame members and a cable attached to the winch, the cable also being attached to an non-moving part of the structure;

a ramp located in the area where the tail of the sailplane is to be located when the sailplane is in the storage structure, the ramp comprising means for receiving a tail wheel of the sailplane and for holding the tail of the sailplane in an elevated position;

a trough leading to the ramp, the trough comprising means for guiding a tail wheel of the sailplane to the ramp; a battery and a solar panel, said battery being operatively connected to the electrically operable winch means to power the electrically operable winch means, and the solar panel being operatively connected to the battery to charge the battery.

17. A storage structure in accordance with claim 16 further comprising switch means operatively connected to the battery and the electrically operable winch means, the switch means being adapted for providing direct current of either polarity to the electrically operable winch means at the option of a user, whereby the second set of frame members are raised or lowered at the option of the user to open or close the structure.

18. A storage structure in accordance with claim 17 where the cover members comprise corrugated metal panels.

19. A storage structure m accordance with claims 18 further comprising insulating foam mounted between the corrugated metal panels and the respective first and second frame members to which the panels are attached.

* * * * *